US009348268B2

(12) United States Patent
Hatano

(10) Patent No.: US 9,348,268 B2
(45) Date of Patent: May 24, 2016

(54) BELT UNIT AND IMAGE FORMING APPARATUS

(71) Applicant: CANON KABUSHIKI KAISHA, Tokyo (JP)

(72) Inventor: Fukashi Hatano, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/641,147

(22) Filed: Mar. 6, 2015

(65) Prior Publication Data

US 2015/0253696 A1 Sep. 10, 2015

(30) Foreign Application Priority Data

Mar. 10, 2014 (JP) ..... 2014-046996

(51) Int. Cl.
*G03G 15/08* (2006.01)
*G03G 15/16* (2006.01)

(52) U.S. Cl.
CPC .... *G03G 15/1615* (2013.01); *G03G 2215/0132* (2013.01)

(58) Field of Classification Search
CPC ..... G03G 21/168; G03G 15/1615; G03G 15/161; G03G 2215/0132; G03G 21/16
USPC ..... 399/121
See application file for complete search history.

(56) References Cited

U.S. PATENT DOCUMENTS

2009/0196651 A1* 8/2009 Yamada ..... 399/121
2010/0264576 A1* 10/2010 Tamehira et al. ..... 271/10.11
2012/0070187 A1* 3/2012 Takeuchi et al. ..... 399/111
2013/0156476 A1* 6/2013 Yokoyama et al. ..... 399/361

FOREIGN PATENT DOCUMENTS

JP 2004109267 A 4/2004

OTHER PUBLICATIONS

Machine translation of Yamauchi JP 2004-109267 A, publication date: Apr. 8, 2004.*

* cited by examiner

*Primary Examiner* — Walter L Lindsay, Jr.
*Assistant Examiner* — Frederick Wenderoth
(74) *Attorney, Agent, or Firm* — Canon USA Inc. IP Division

(57) ABSTRACT

A belt unit includes an endless belt; multiple rollers including a tension roller that applies tension to the belt; a frame to which the multiple rollers are attached; bearing members which are movably attached to the frame and at least one of which is detachable from the frame; and urging units that urge the bearing members from the inner-peripheral-surface side to the outer-peripheral-surface side of the belt. The detachable bearing member includes a hole part that receives a rotation shaft of the tension roller and that rotatably supports the rotation shaft; and a guide surface that guides the shaft to an opening of the hole part while the bearing member is moving toward the frame against the urging force of the urging unit to be attached to the frame.

13 Claims, 11 Drawing Sheets

BELT UNIT AND IMAGE FORMING APPARATUS

BACKGROUND OF THE INVENTION

1. Field of the Invention

The present invention relates to a belt unit used in an electrophotographic or electrostatic-recording image forming apparatus such as a copying machine, a printer, or a facsimile, and the image forming apparatus.

2. Description of the Related Art

For example, conventional electrophotographic image forming apparatuses use endless belts (each also referred to simply as a "belt" below) as a photosensitive belt, a transfer material conveying belt, an intermediate transfer belt, and the like. These belts may be damaged due to aging or fatigue attributable to many hours of driving, and hence require periodic replacement in many cases.

As a method of replacing such a belt, Japanese Patent Laid-Open No. 2004-109267 discloses the following. Specifically, a support unit that supports rollers around which a belt is stretched is formed so as to be foldable into two. To replace the belt, the support unit is folded so that the projected area defined by the outer-edge line of the support unit is smaller than that defined by the outer periphery of the belt when viewed from the side-surface side. In a different method, a support unit is formed of a pair of separable frames. To replace a belt, the frames are separated by unscrewing screws, and a roller is detached.

However, the above-described conventional methods often require a complex configuration and complicated operation for attaching and detaching the belt, which may cause damage to the belt during replacement of the belt.

SUMMARY OF THE INVENTION

An aspect of the present invention provides a belt unit that includes an endless belt; and a support unit that supports the belt. The support unit includes a tension roller that includes a rotation shaft and around which the belt is stretched; a bearing that is attachable to and detachable from the support unit, that rotatably supports the rotation shaft, and that includes a hole part into which the rotation shaft is inserted and a guide part that includes a guide path extending to the hole part and raised at two sides and that is formed so that an end of the rotation shaft abutting on part of the guide path is guided to the hole part along the guide path when the bearing is moved toward the tension roller to be attached to the support unit; a support part that supports the bearing in a state where the bearing is movable in a direction intersecting with the rotation shaft; and an urging member that is disposed between the support part and the bearing and that applies tension to the belt by applying force in the direction intersecting with the rotation shaft to the tension roller via the bearing.

Another aspect of the present invention provides an image forming apparatus including the above-described belt unit.

Further features of the present invention will become apparent from the following description of exemplary embodiments with reference to the attached drawings.

DESCRIPTION OF THE EMBODIMENTS

A belt unit and an image forming apparatus according to the present invention will be described below in more detail with reference to the drawings.

Embodiment 1

1. Overall Configuration and Operation of Image Forming Apparatus

Figure 1:
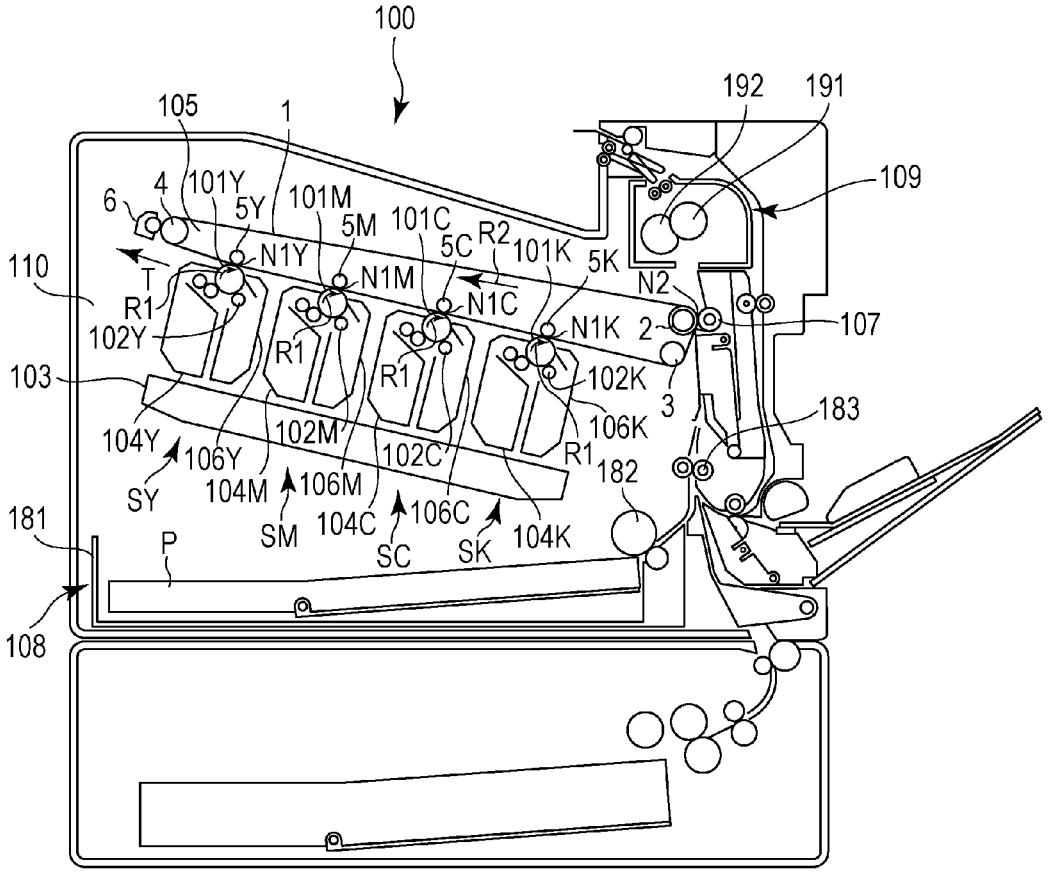
FIG. 1 is a schematic cross-sectional view of an image forming apparatus.

FIG. 1 is a schematic cross-sectional view of an image forming apparatus according to an embodiment of the present invention. An image forming apparatus 100 of this embodiment is an intermediate-transfer-type tandem laser beam printer capable of electrophotographically forming images in full color.

The image forming apparatus 100 includes first, second, third, and fourth image forming units SY, SM, SC, and SK as multiple image forming units. The image forming units SY, SM, SC, and SK form images in yellow (Y), magenta (M), cyan (C), and black (K), respectively.

In this embodiment, the configurations and operations of the image forming units SY, SM, SC, and SK are substantially the same except for that the colors of toners being used are different. Accordingly, in the following, Y, M, C, and K, which are included at the ends of signs to each represent a component for a corresponding one of the colors, are omitted where no particular differentiation is needed, and description will be given of the components collectively.

The image forming unit S includes a photosensitive drum 101, which is a drum (cylindrical) electrophotographic photoreceptor (photoreceptor) serving as an image bearing member. The photosensitive drum 101 is rotary driven in the direction indicated by an arrow R1 in FIG. 1. Around the photosensitive drum 101, the following units are provided. To start with, a charging roller 102, which is a roller-shaped charging member serving as a charging unit, is provided. A developing device 104 serving as a developing unit is provided. A drum cleaner 106 serving as a photoreceptor cleaner is provided. An exposure device (laser scanner) 103 serving as an exposure unit is provided to be able to expose the photosensitive drums 101Y, 101M, 101C, and 101K. An intermediate transfer belt unit 105 serving as a belt conveying device is provided in such a way as to face the photosensitive drums 101Y, 101M, 101C, and 101K.

The intermediate transfer belt unit 105 includes an intermediate transfer belt 1, which is an endless belt serving as an intermediate transfer member and is provided in such a way as to face the photosensitive drums 101Y, 101M, 101C, and 101K. The intermediate transfer belt 1 is stretched around a driving roller 2, a driven roller 3, and a tension roller 4, which serve as multiple rollers (stretching members). When the driving roller 2 is rotary driven, the intermediate transfer belt 1 rotates (circularly moves) in the direction indicated by an arrow R2 in FIG. 1. As will be described later in detail, the tension roller 4 is urged from the inner-peripheral-surface side to the outer-peripheral-surface side of the intermediate transfer belt 1 as indicated by an arrow T in FIG. 1. In this way, a predetermined tension is applied to the intermediate transfer belt 1. At positions facing the respective photosensitive drums 101Y, 101M, 101C, and 101K on the inner-peripheral-surface side of the intermediate transfer belt 1, primary transfer rollers 5Y, 5M, 5C, and 5K, which are primary transfer roller members serving as primary transfer units, are provided. Each primary transfer roller 5 is urged toward (pressed against) the photosensitive drum 101 via the intermediate transfer belt 1 with a predetermined pressure to form a primary transfer section N1, in which the intermediate transfer belt 1 and the photosensitive drum 101 are in contact. A secondary transfer roller 107, which is a secondary transfer roller member serving as a secondary transfer unit, is provided so as to face the driving roller 2 on the outer-peripheral-surface side of the intermediate transfer belt 1. The secondary transfer roller 107 is urged toward (pressed against) the driving roller 2 via the intermediate transfer belt 1 with a predetermined pressure to form a secondary transfer section N2, in which the intermediate transfer belt 1 and the secondary transfer roller 107 are in contact. A belt cleaner 6 serving as an intermediate-transfer-member cleaner is provided so as to face the tension roller 4 on the outer-peripheral-surface side of the intermediate transfer belt 1.

In addition to the above, a feeding device 108, which feeds a transfer material P to the secondary transfer section N2, and a fixing device 109, which fixes a toner image onto the transfer material P, for example, are provided in the image forming apparatus 100.

In image formation, the surface of each photosensitive drum 101 rotating in the direction indicated by the arrow R1 (clockwise) is uniformly charged by the charging roller 102, and the charged surface of the photosensitive drum 101 is subjected to scanning exposure by the exposure device 103. Thereby, an electrostatic latent image (electrostatic image) is formed on the photosensitive drum 101. The electrostatic latent image formed on the photosensitive drum 101 is developed as a toner image by the developing device 104 by using toner as a developer. In this embodiment, a toner image is formed by discharged-area development, in which toner charged to the same polarity as the charge polarity of the photosensitive drum 101 (negative polarity in this embodiment) is transferred onto an exposed part (lighted part) of the photosensitive drum 101, the exposed part having a decreased absolute value of the electric potential as a result of being uniformly charged and exposed. The toner image formed on the photosensitive drum 101 is transferred onto the intermediate transfer belt 1 rotating in the direction indicated by the arrow R2 (counterclockwise), by utilizing the primary transfer roller 5 in the primary transfer section N1 (primary transfer). In the primary transfer, a primary transfer voltage (primary transfer bias), which is a direct-current voltage having a polarity (positive polarity in this embodiment) opposite to the charge polarity of the toner in development, is applied to the primary transfer roller 5 by a primary transfer power source (not illustrated) serving as a voltage applying unit. For example, in full-color image formation, toner images formed on the respective photosensitive drums 101Y, 101M, 101C, 101K are sequentially transferred onto the intermediate transfer belt 1 in such a way as to overlap each other.

The toner images formed on the intermediate transfer belt 1 are transferred onto the transfer material P, such as a recording sheet, held and conveyed by the intermediate transfer belt 1 and the secondary transfer roller 107, by utilizing the secondary transfer roller 107 in the secondary transfer section N2 (secondary transfer). In the secondary transfer, a secondary transfer voltage (secondary transfer bias), which is a direct-current voltage having a polarity (the positive polarity in this embodiment) opposite to the charge polarity of the toner in development, is applied to the secondary transfer roller 107 by a secondary transfer power source (not illustrated) serving as a voltage applying unit. For example, in full-color image formation, the overlapping toner images, which are formed in such a way that the toners of four colors overlap each other on the intermediate transfer belt 1, are conveyed by the intermediate belt 1 to move to the secondary transfer section N2, and are transferred onto the transfer material P all together in the secondary transfer section N2. In the feeding device 108, the transfer material P is sent out from, for example, a transfer material cassette 181 by, for example, a feeding roller 182, and is conveyed to the secondary transfer section N2 by a registration roller 183 in exact timing with the move of the toner images on the intermediate transfer belt 1.

The transfer material P onto which the toner image has been transferred is conveyed to the fixing device 109, and is heated and pressed in a fixing nip section between a fixing roller 191 and a pressing roller 192 included in the fixing device 109. In this way, the unfixed toner image on the surface of the transfer material P is fixed onto the surface of the transfer material P. When the toner image is fixed, the transfer material P is discharged (outputted) to the outside of the image forming apparatus 100.

Meanwhile, the toner remaining on the photosensitive drum 101 after the primary transfer (primary-transfer residual toner) is removed from the photosensitive drum 101 by the drum cleaner 106. The drum cleaner 106 removes the toner in such a way that a cleaning blade serving as a cleaning member scrapes off the toner from the surface of the rotating photosensitive drum 101. The toner remaining on the intermediate transfer belt 1 after the secondary transfer (secondary-transfer residual toner) is removed from the intermediate transfer belt 1 by the belt cleaner 6. The belt cleaner 6 removes the toner in such a way that a cleaning blade serving as a cleaning member scrapes off the toner from the surface of the rotating intermediate transfer belt 1. The removed toner is collected in a toner collection container (not illustrated) through a collected-toner conveying path (not illustrated).

2. Intermediate Transfer Belt Unit

Next, the intermediate transfer belt unit 105 of this embodiment will be described further. Note that description will be given of the image forming apparatus 100 and the components thereof under the assumption that the side shown in the sheet presenting FIG. 1 is a "front side," and the side opposite to the side shown in the sheet presenting FIG. 1 is a "back side." The depth direction connecting the front side to the back side is approximately parallel to the direction of the rotation axis of each of the photosensitive drum 101 and the rollers 2, 3, and 4, around which the intermediate transfer belt 1 is stretched. With regard to the intermediate transfer belt unit 105 and the components of the intermediate transfer belt unit 105, the direction corresponding to the width direction (the direction approximately orthogonal to the conveying direction) of the intermediate transfer belt 1 is referred to also as a "thrust direction."

In this embodiment, the intermediate transfer belt unit 105 is attachable to and detachable from a main body 110 of the image forming apparatus 100. In addition, in this embodiment, the intermediate transfer belt 1 is attachable to and detachable from the intermediate transfer belt unit 105 detached from the main body 110, which makes it possible for the intermediate transfer belt 1 that has reached the end of its life to be replaced with a new one.

Figure 2:
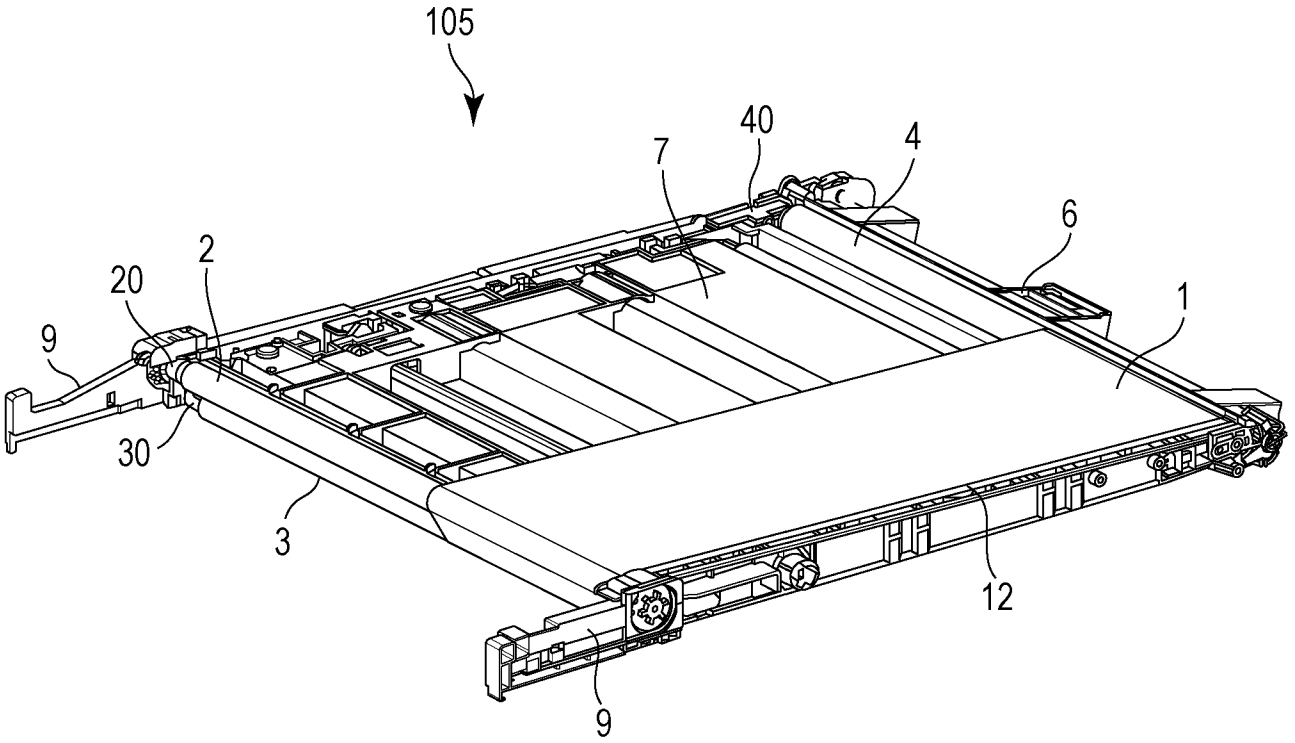
FIG. 2 is a perspective view of an intermediate transfer belt unit.

FIG. 2 is a perspective view of the intermediate transfer belt unit 105. The intermediate transfer belt unit 105 includes the intermediate transfer belt 1 (which is presented in FIG. 2 in such a way that the front-side part of the intermediate transfer belt 1 is detached). The intermediate transfer belt unit 105 further includes the driving roller 2, the driven roller 3, and the tension roller 4 as multiple rollers around which the intermediate transfer belt 1 is stretched. The driving roller 2, the driven roller 3, and the tension roller 4 are attached to a frame (main frame) 7.

The driving roller 2 is rotatably supported by driving-roller bearing members 20 (only the front-side one is presented in FIG. 2) at the two longitudinal-direction (rotation-axis-direction) ends of the driving roller 2. The driving-roller bearing members 20 are attached to the frame 7. The driving roller 2 is driven by a driving unit (not illustrated) to rotate. The rotational drive of the driving roller 2 rotates the intermediate transfer belt 1. To rotate the intermediate transfer belt 1 without any occurrence of a skid, the surface of the driving roller 2 is formed of a rubber layer having a high friction coefficient.

The driven roller 3 is rotatably supported by driven-roller bearing members 30 (only the front-side one is presented in FIG. 2) at the two longitudinal-direction (rotation-axis-direction) ends of the driven roller 3. The driven-roller bearing members 30 are attached to the frame 7. The driven roller 3 rotates with the rotation of the intermediate transfer belt 1.

The tension roller 4 is rotatably supported by tension-roller bearing members (also referred to simply as "bearing members" below) 40 (only the front-side one is presented in FIG. 2) at the two longitudinal-direction (rotation-axis-direction) ends of the tension roller 4. The bearing members 40 are movably (slidably) attached to the frame 7. The bearing members 40 at the two longitudinal-direction ends of the tension roller 4 are urged with compressive forces of tension springs 8 (FIG. 10), each of which is formed by a compression spring serving as an urging unit. The bearing members 40 are moved (slid) from the inner-peripheral-surface side to the outer-peripheral-surface side of the intermediate transfer belt 1 in the urging direction of the tension springs 8. Thus, the tension roller 4 urges the intermediate transfer belt 1 from the inner-peripheral-surface side to the outer-peripheral-surface side of the intermediate transfer belt 1 to apply tension to the intermediate transfer belt 1.

The belt cleaner 6 is provided so as to face the tension roller 4. In addition, grips 9 are provided that are used in operation for attaching and detaching the intermediate transfer belt unit 105 to and from the main body 110. One of the grips 9 is attached to the longitudinal-direction ends of the driving roller 2 and the driven roller 3 on one side of the frame 7, while the other grip 9 is attached to the longitudinal-direction ends of the driving roller 2 and the driven roller 3 on the other side of the frame 7. The belt cleaner 6 and the grips 9 are detachably attached to the frame 7.

Note that, in this embodiment, the frame 7 does not substantially change in shape between when the intermediate transfer belt 1 is rotating and when the intermediate transfer belt 1 is being detached. In particular, in this embodiment, the frame 7 is formed integrally. The two bearing members 40 for the tension roller 4, the belt cleaner 6, and the grips 9 are designed so as to be easily detached from the frame 7.

Figure 3:
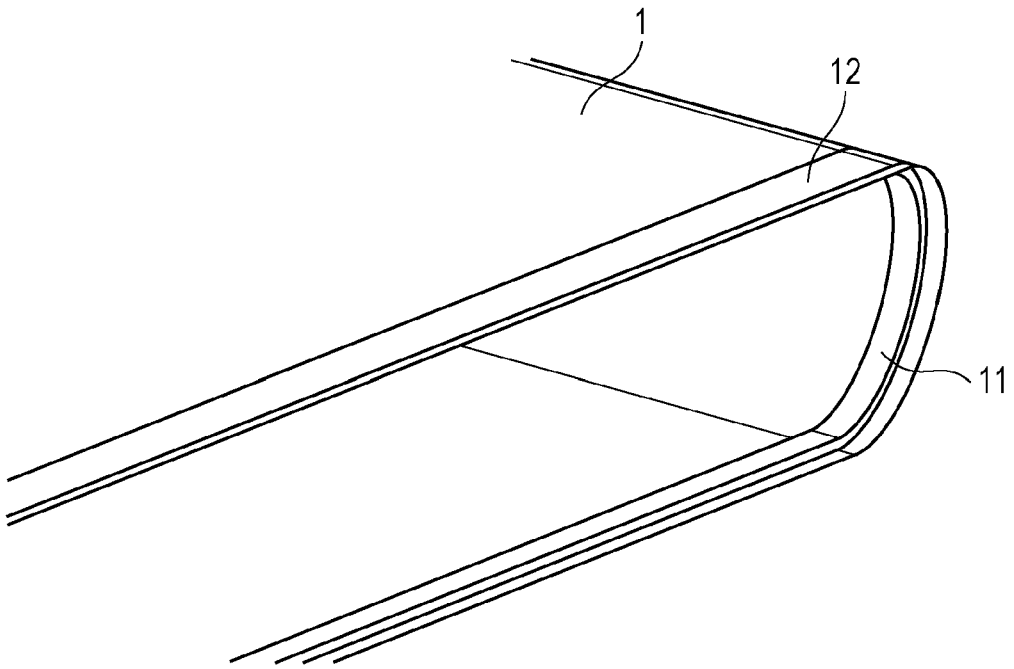
FIG. 3 is an enlarged perspective view of an intermediate transfer belt.

FIG. 3 illustrates the intermediate transfer belt 1 of this embodiment. The base layer of the intermediate transfer belt 1 is made from a resin material having a high tensile strength, such as polyimide (PI), polyvinylidene difluoride (PVDF), polyphenylene sulfide (PPS), polyether ether ketone (PEEK), or polyethylene naphthalate (PEN). In consideration of the requirements in terms of formability, strength, deformability, and the like, the thickness of the base layer is often set in the range from 40 μm to 100 μm. For example, to increase the efficiency of transfer of toner, a multilayered structure may be employed in which a different layer such as a rubber layer is attached to the entire outer peripheral surface of the base layer. The intermediate transfer belt 1 of this embodiment may have either of the structures. On each of the width-direction ends of the intermediate transfer belt 1, a rib 11 serving as a regulation unit for regulating change (deviation) of the width-direction position of the intermediate transfer belt 1 is attached to the inner peripheral surface of the intermediate transfer belt 1. On each of the width-direction ends of the intermediate transfer belt 1, a reinforcing tape 12 is attached to the outer peripheral surface of the intermediate transfer belt 1, the reinforcing tape 12 serving as a reinforcing unit for reinforcing the intermediate transfer belt 1 so as to prevent the intermediate transfer belt 1 from tearing. As the rib 11, a belt-shaped urethane member having a width (width-direction length of the intermediate transfer belt 1) of 3 mm and a thickness of 1.2 mm is used. As the reinforcing tape 12, an adhesive film tape is used. The adhesive film tape may be made of any material having a sufficient tensile strength. As the film of the adhesive film tape, a film made of, for example, a resin material such as polyester or a resin material such as polyimide (PI), which is the same as the material of the base layer of the intermediate transfer belt 1, may be used. As a pressure sensitive adhesive of the adhesive film tape, a general material such as an acrylic material or a silicone material may be used.

3. Procedure for Replacing Intermediate Transfer Belt

Next, a procedure for replacing the intermediate transfer belt 1 according to this embodiment will be described with reference to FIG. 4 to FIG. 8.

Figure 4:
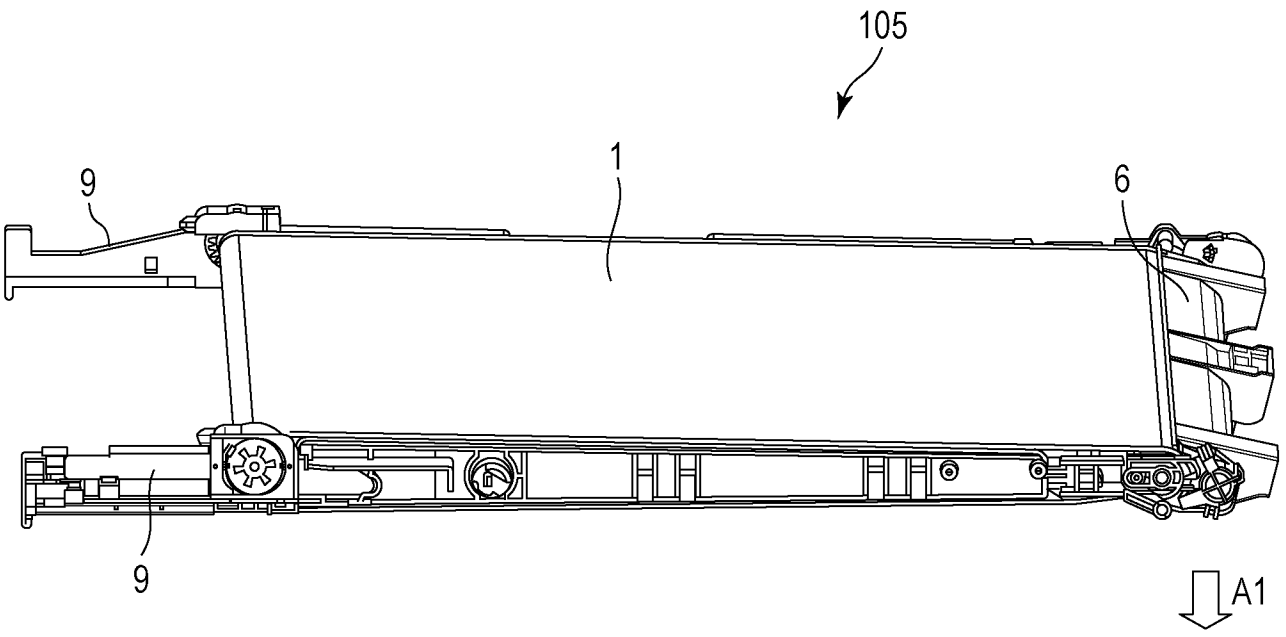
FIG. 4 is a perspective view of the intermediate transfer belt unit for illustrating a procedure for replacing the intermediate transfer belt.
Figure 5:
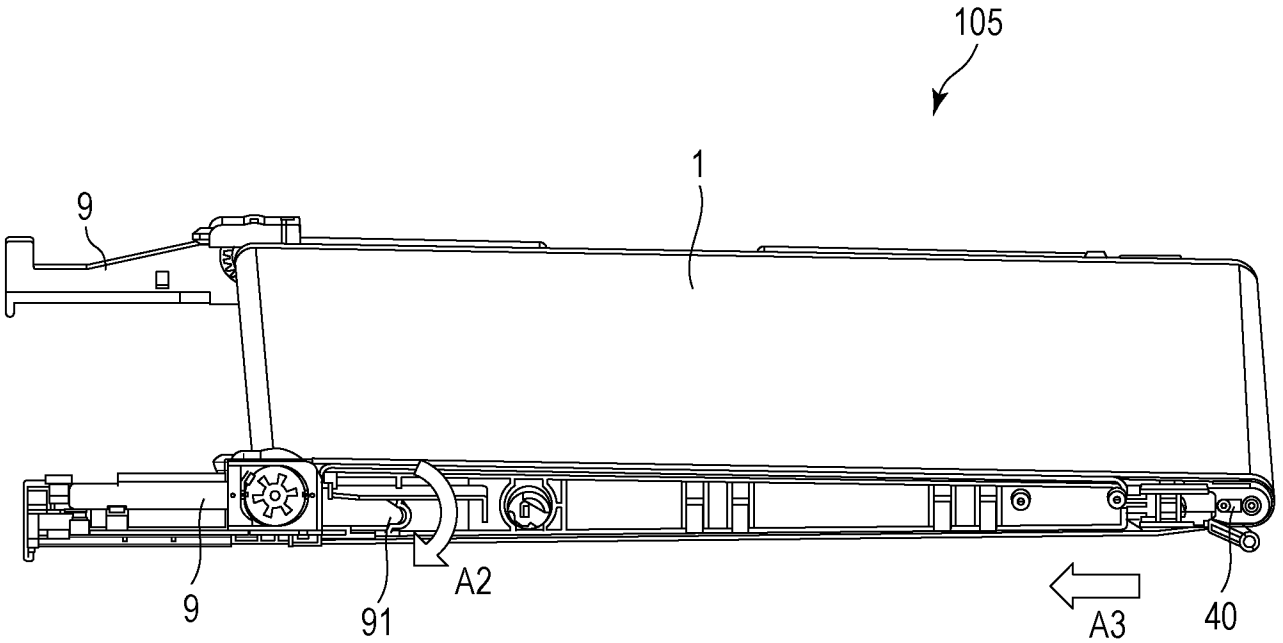
FIG. 5 is a perspective view of the intermediate transfer belt unit for illustrating the procedure for replacing the intermediate transfer belt.

First, to detach the intermediate transfer belt 1, the intermediate transfer belt unit 105 is dismounted from the main body 110, and is placed horizontally so that the surface of the intermediate transfer belt 1 stretching between the driven roller 3 and the tension roller 4 is positioned approximately horizontally (FIG. 4). In this state, the intermediate transfer belt unit 105 should be placed so that the surface faces downward. In the state where the intermediate transfer belt unit 105 is placed as described above, the belt cleaner 6 is detached from the frame 7 (FIG. 5) in such a way that a fastening member (not illustrated) provided on the front side (the back side in FIG. 4) of the belt cleaner 6 is taken off from the belt cleaner 6 and the belt cleaner 6 is slid toward the back side (the front side in FIG. 4) as indicated by an arrow A1 in FIG. 4.

Figure 6:
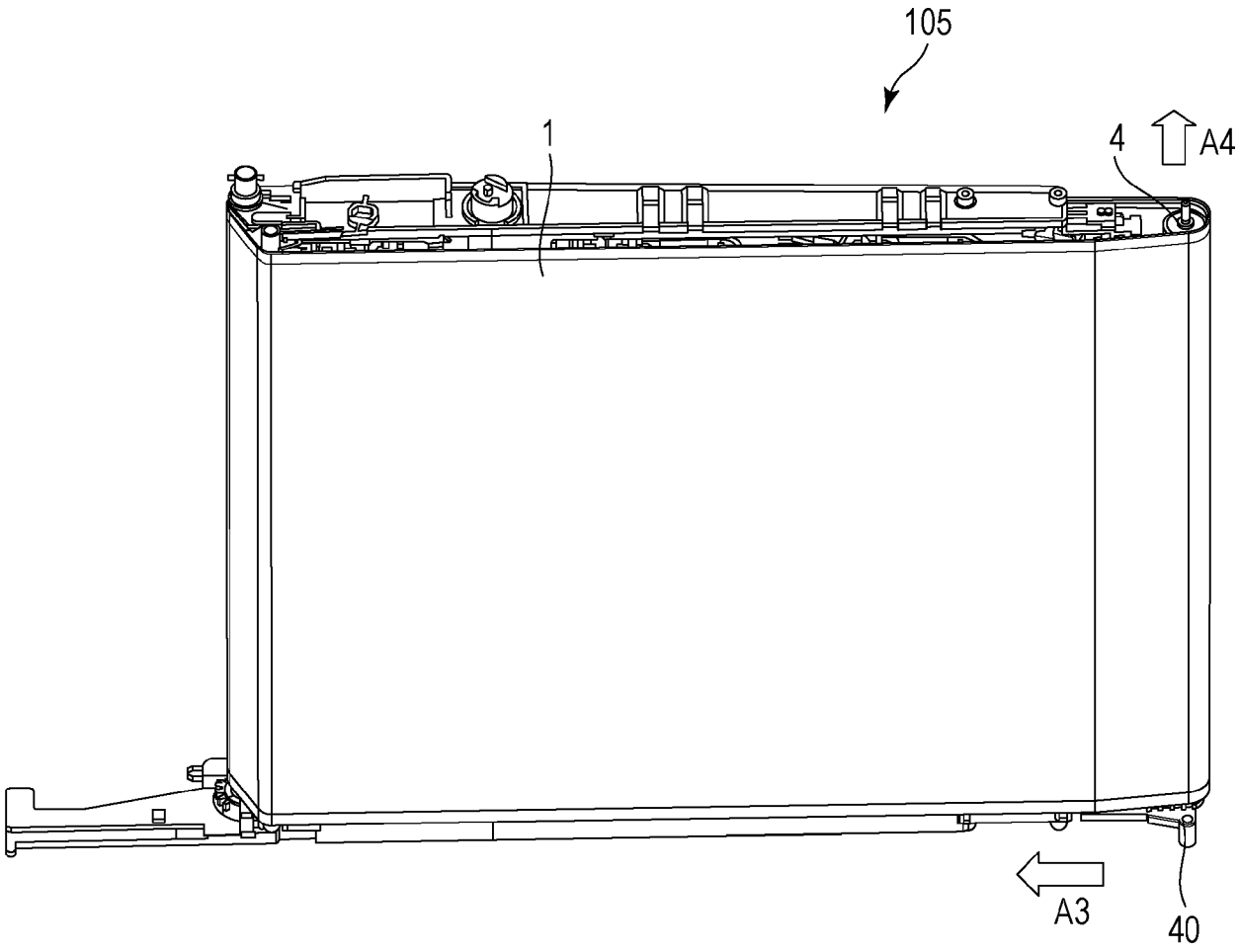
FIG. 6 is a perspective view of the intermediate transfer belt unit for illustrating the procedure for replacing the intermediate transfer belt.

Then, the intermediate transfer belt unit 105 is placed vertically so that the surface of the intermediate transfer belt 1 stretching between the driven roller 3 and the tension roller 4 is positioned approximately vertically (FIG. 6). In this state, the intermediate transfer belt unit 105 should be placed so that the front side (back side in FIG. 5) of the intermediate transfer belt unit 105 faces downward. In the state where the intermediate transfer belt unit 105 is placed as described above, the back-side (front-side in FIG. 5) grip 9 and the back-side (front-side in FIG. 5) bearing member 40, which is one of the bearing members 40 for the tension roller 4, are detached from the frame 7. The grip 9 can be detached from the frame 7 by disengaging a snap-fit part 91, which is provided to the grip 9, from the frame 7, rotating the grip 9 in the direction indicated by an arrow A2 in FIG. 5, and pulling the grip 9 out from the driving roller 2. The bearing member 40 can be detached from the frame 7 by sliding the bearing member 40 in the direction indicated by an arrow A3 in FIG. 5 while compressing the corresponding tension spring 8, and pulling the bearing member 40 out from the tension roller 4. The tension spring 8 is detached from the frame 7 at the same time as the bearing member 40. Attachment and detachment of the bearing member 40 will be described later in more detail.

Figure 7:
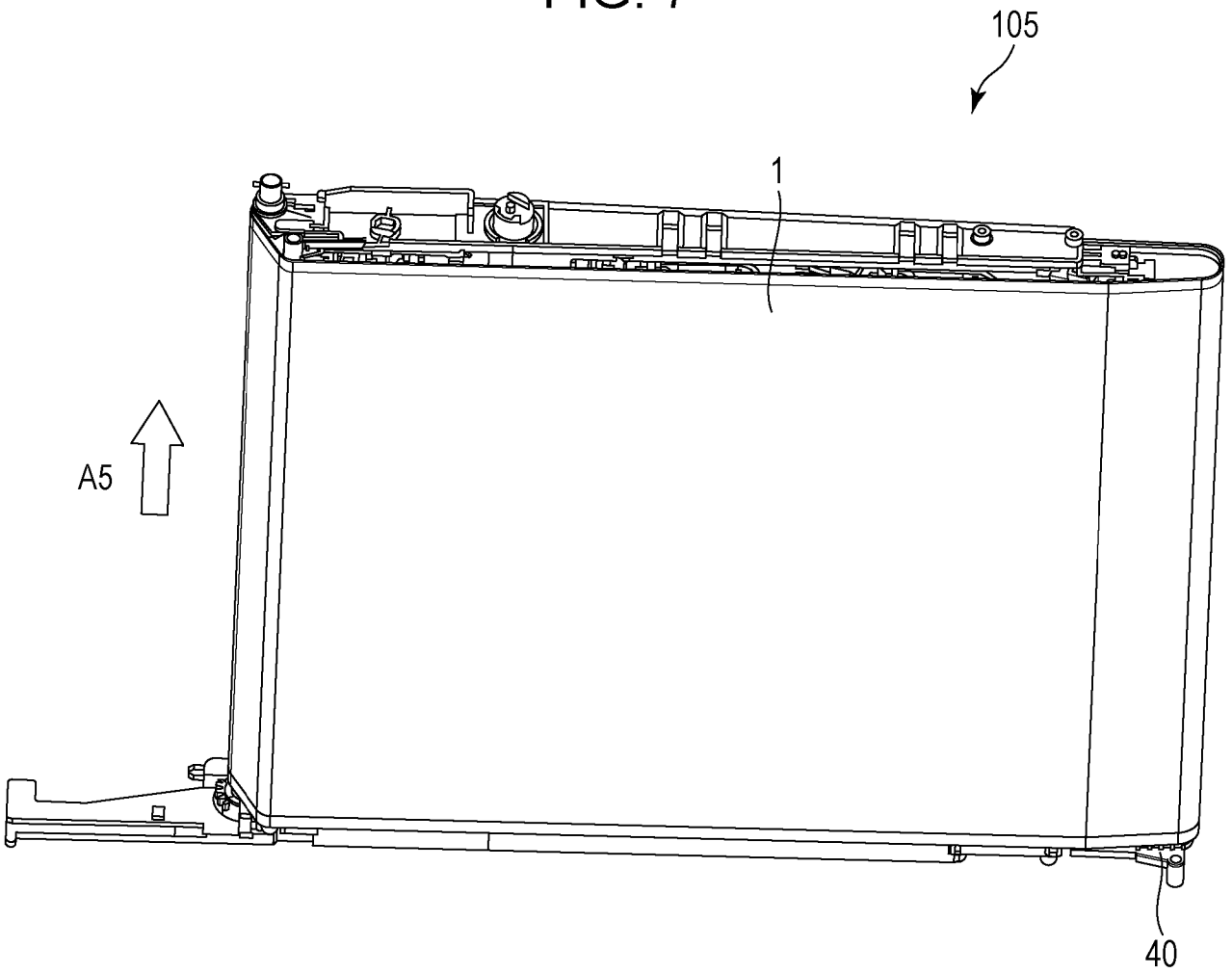
FIG. 7 is a perspective view of the intermediate transfer belt unit for illustrating the procedure for replacing the intermediate transfer belt.

In the state illustrated in FIG. 6, the front-side (bottom-side in FIG. 6) bearing member 40, which is the other bearing member for the tension roller 4, is slid in the direction indicated by the arrow A3 in FIG. 6 while compressing the corresponding tension spring 8. In this way, the tension of the intermediate transfer belt 1 is loosened, and the tension roller 4 is pulled upward as indicated by an arrow A4 in FIG. 6, thereby detaching the tension roller 4 from the frame 7 (FIG. 7). Note that, in this embodiment, the two bearing members 40 for the tension roller 4 have substantially the same configuration, and hence the front-side bearing member 40 can be detached from the frame 7 as the above-described back-side bearing member 40. However, typically, the amount of slide of the front-side bearing member 40 is set smaller than that of the above-described back-side bearing member 40 so as to prevent the front-side bearing member 40 from coming off from the frame 7. This reduces the number of components that can be separated from the frame 7, which makes it easier for the intermediate transfer belt 1 to be replaced.

Figure 8:
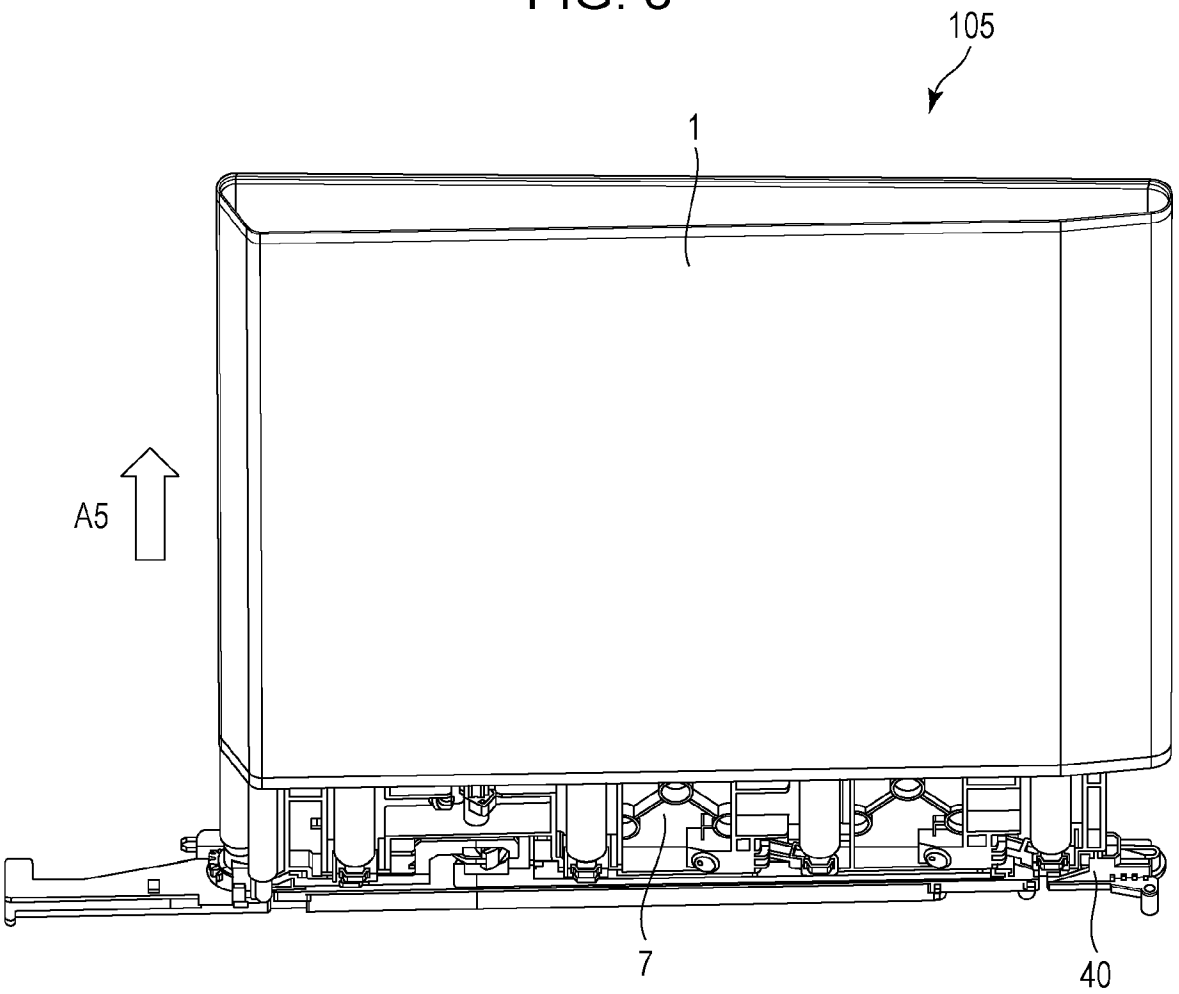
FIG. 8 is a perspective view of the intermediate transfer belt unit for illustrating the procedure for replacing the intermediate transfer belt.

After the tension roller 4 is detached from the frame 7, the intermediate transfer belt 1 is loosened by using the space generated by detaching the tension roller 4, and is pulled upward as indicated by an arrow A5 in FIG. 7 and FIG. 8, thus detaching the intermediate transfer belt 1 from the frame 7 (FIG. 8). By detaching the tension roller 4 from the frame 7 by detaching at least one of the bearing members 40 from the frame 7, the intermediate transfer belt 1 can be detached from the frame 7 without detaching any of the other rollers among the multiple rollers from the frame 7.

Note that the intermediate transfer belt 1 can be attached by following the above-described procedure in reverse order.

4. Attachment and Detachment of Bearing Member

Figure 9:
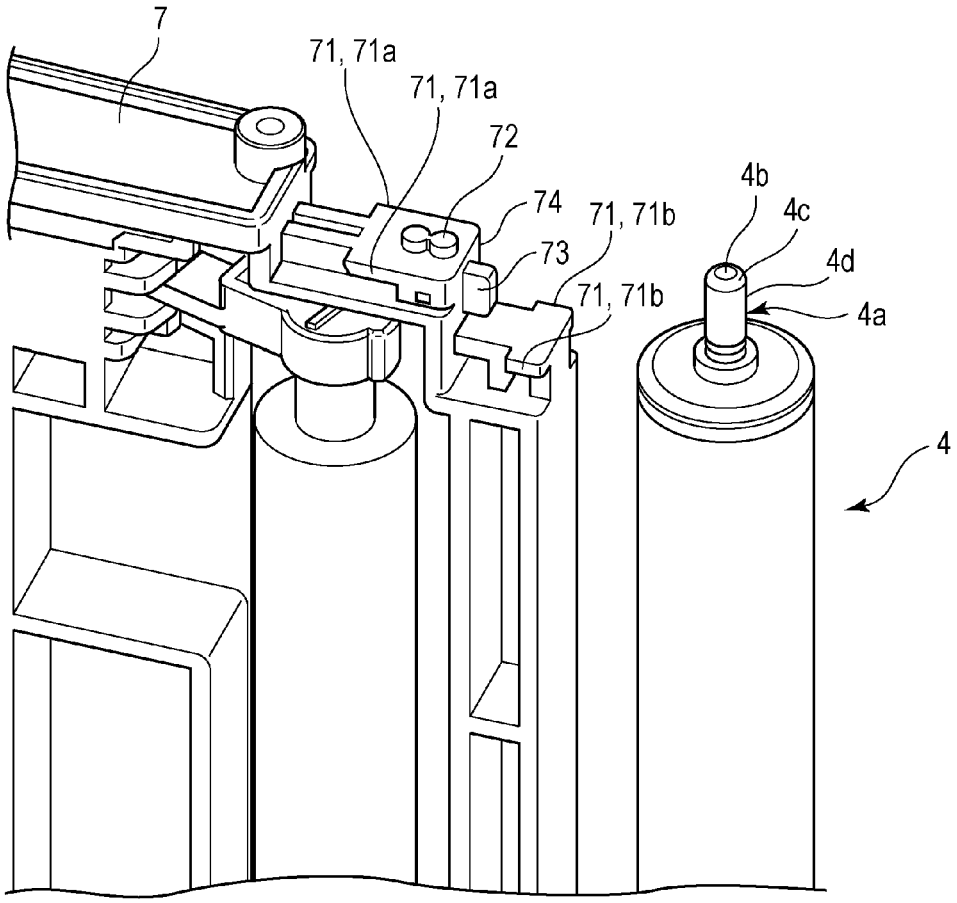
FIG. 9 is an enlarged perspective view of an area in which the bearing member is to be attached to the frame.

Next, the configuration related to attachment and detachment of the bearing member 40 will be described in more detail. FIG. 9 is a perspective view illustrating, in more detail, an area of the frame 7 in which the back-side bearing member 40 for the tension roller 4 is attached.

The back-side side surface of the frame 7 includes rail parts 71 each serving as a frame-side engaging unit, a boss 72 serving as a moving-direction regulating unit, and a spring latching part 73 for hooking and latching the tension spring 8.

The rail parts 71 are movably (slidably) engaged with respective nail parts 41 of the bearing member 40 to be described later, to support the bearing member 40. In this embodiment, the rail parts 71 are provided at four respective positions. Specifically, two of the rail parts 71 are provided upstream of the urging direction of the tension spring 8, and the other two of the rail parts 71 are provided downstream of the urging direction, in such a way that the spring latching part 73 is positioned between the rail parts 71 provided upstream and the rail parts 71 provided downstream. Of the rail parts 71, the two rail parts 71 provided upstream are also referred to as upstream rail parts 71*a*, and the two rail parts 71 provided downstream are also referred to as downstream rail parts 71*b*. The upstream rail parts 71*a* are provided at positions in the frame 7 that are located further out than the positions at which the downstream rail parts 71*b* are provided. Each of the rail parts 71 engages, at a surface of the rail part 71, with a corresponding one of the nail parts 41 of the bearing member 40, the surface extending in the urging direction of the tension spring 8 and facing inward in the thrust direction of the frame 7.

The boss 72 defines the center of slide of the bearing member 40. In this embodiment, the boss 72 is formed as a protrusion protruding outward in the thrust direction of the frame 7.

The spring latching part 73 is formed as a protrusion protruding in the urging direction of the tension spring 8 from a step part 74 between the upstream rail parts 71*a* and the downstream rail parts 71*b*.

As illustrated in FIG. 9, a rotation shaft 4*a* extending in the longitudinal direction of the tension roller 4 is provided at each end of the tension roller 4. The tension roller 4 is rotatably supported by the bearing members 40 via the rotation shafts 4*a*. In this embodiment, as illustrated in FIG. 9, each of the rotation shafts 4*a* of the tension roller 4 includes a rounded part 4*c*, in which an end part 4*b* is connected to a side part 4*d* of the rotation shaft 4*a* with a curved surface.

Figure 10:
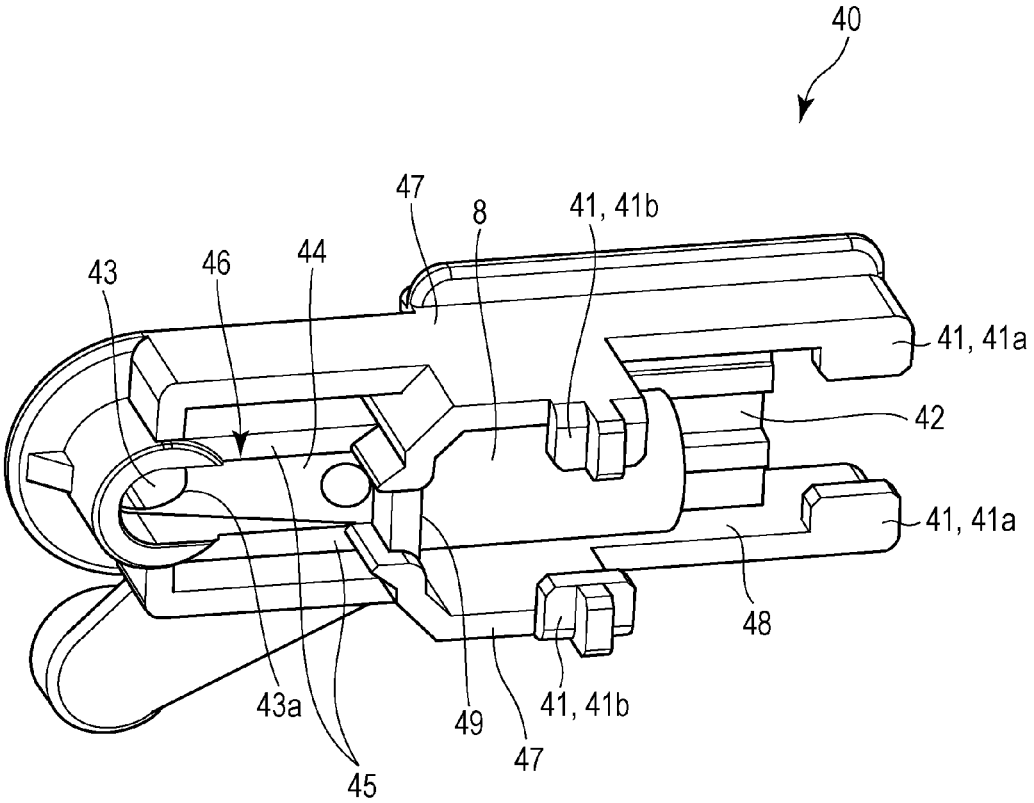
FIG. 10 is a perspective view of the bearing member.

FIG. 10 is a perspective view illustrating, in more detail, the back-side bearing member 40 for the tension roller 4. In FIG. 10, the side of the bearing member 40 to be positioned so as to face the frame 7 is illustrated.

The bearing member 40 includes the nail parts 41 each serving as a bearing-side engaging unit, a slide rail part 42 serving as a moving-direction regulation receiving unit, and a hole part 43 receiving and rotatably supporting the rotation shaft 4*a* of the tension roller 4.

The nail parts 41 movably (slidably) engage with the respective rail parts 71 of the frame 7 to hold the bearing member 40 at the frame 7. In this embodiment, the nail parts 41 are provided at four respective positions. Specifically, two of the nail parts 41 are provided upstream of the urging direction of the tension spring 8 so as to engage with the respective upstream rail parts 71*a* of the frame 7, and the other two of the nail parts 41 are provided downstream of the urging direction so as to engage with the downstream rail parts 71*b* of the frame 7. The two nail parts 41 provided upstream are also referred to as upstream nail parts 41*a*, and the two nail parts 41 provided downstream are also referred to as downstream nail parts 41*b*. Each of the nail parts 41 engages, at the surface extending in the urging direction of the tension spring 8 and facing the thrust-direction outer side of the frame 7, with the corresponding one of the rail parts 71 of the frame 7.

The slide rail part 42 extends in the moving direction of the bearing member 40, and the boss 72 of the frame 7 is movably fitted to the slide rail part 42. When the bearing member 40 moves, the boss 72 of the frame 7 slides in the slide rail part 42.

The hole part 43 is formed near an end of the bearing member 40, the end being positioned downstream of the urging direction of the tension spring 8. The rotation shaft 4*a* of the tension roller 4 is rotatably fitted to the hole part 43.

In this embodiment, the tension spring 8 is attachable to and detachable from the frame 7 together with the bearing member 40. Specifically, in this embodiment, the bearing member 40 is integrated with the tension spring 8 in such a way that the tension spring 8 is lightly press fitted between side walls 47, each of which extends in the urging direction of the tension spring 8 and which face each other. With this configuration, it is possible to reduce the likelihood of a situation such as one where the tension spring 8 is dropped and consequently the intermediate transfer belt 1 becomes damaged, or one where the tension spring 8 jumps out and is consequently lost, in the course of attaching or detaching the bearing member 40 to or from the frame 7. In addition, in this embodiment, the bearing member 40 includes an exposing part 48, which exposes the tension spring 8 to the frame 7. The exposing part 48 exposes the tension spring 8 to the frame 7 so that one end of the tension spring 8 can be engaged with the spring latching part 73 serving as a predetermined portion of the frame 7 when the bearing member 40 is being attached to the frame 7. Specifically, in this embodiment, the exposing part 48 is provided in an area that is positioned between the side walls 47, facing each other, of the bearing member 40 and that is positioned between the upstream nail parts 41*a* and the downstream nail parts 41*b* in the urging direction of the tension spring 8.

In this embodiment, the bearing member 40 includes a guide surface 44, which guides the rotation shaft 4*a* to an opening 43*a* of the hole part 43 so as to attach the bearing member 40 to the frame 7. In the course of attaching the bearing member 40 to the frame 7, the guide surface 44 comes into contact with the end part 4*b* of the rotation shaft 4*a* of the tension roller 4 to guide the rotation shaft 4*a* to the opening 43*a* of the hole part 43 while causing the bearing member 40 to move toward the frame 7 against the urging force of the tension spring 8. In other words, while the bearing member 40 is moving toward the frame 7 against the urging force of the tension spring 8 to be attached to the frame 7, the guide surface 44 guides the rotation shaft 4*a* to the opening 43*a* of the hole part 43. The guide surface 44 is formed as an inclined surface that is inclined downward to the opening 43*a* of the hole part 43 (i.e., inclined downward from the thrust-direction inner side to the thrust-direction outer side of the frame 7). Guide walls 45, which guide the side part 4*d* of the rotation shaft 4*a*, are formed at the respective sides of the guide surface 44 so as to face each other. In other words, the guide face 44 is formed at the bottom part of a guide groove 46 serving as a groove-shaped unit that guides the rotation shaft 4*a*, and the bottom part is a slope inclined toward the opening 43*a* of the hole part 43.

In this embodiment, the configurations of the frame 7, the bearing members 40, and the tension roller 4 at the respective two longitudinal-direction ends of the tension roller 4 are substantially the same in terms of attachment and detachment of the bearing member 40 (substantially symmetric with respect to the thrust-direction center of the frame 7). In this embodiment, description has been given above that the back-side bearing member 40 is detached in order to enable attachment or detachment of the intermediate transfer belt 1. However, the front-side bearing member 40 may be detached instead. Although it is not necessary as described above that both of the bearing members 40 be detached to detach the tension roller 4 and subsequently detach the intermediate transfer belt 1, both of the bearing members 40 may be detached if desired. Making both of the bearing members 40 attachable to and detachable from the frame 7 as in this embodiment enables detachment of the tension roller 4 from any one of the back side and the front side of the frame 7, which consequently increases the degree of flexibility in operation. At the same time, the bearing members 40 for the tension roller 4 only need to be configured so that at least one of the bearing members 40 is attachable to and detachable from the frame 7, and the other bearing member 40 may be configured not to be easily attached to or detached from the frame 7 if desired.

Figure 11:
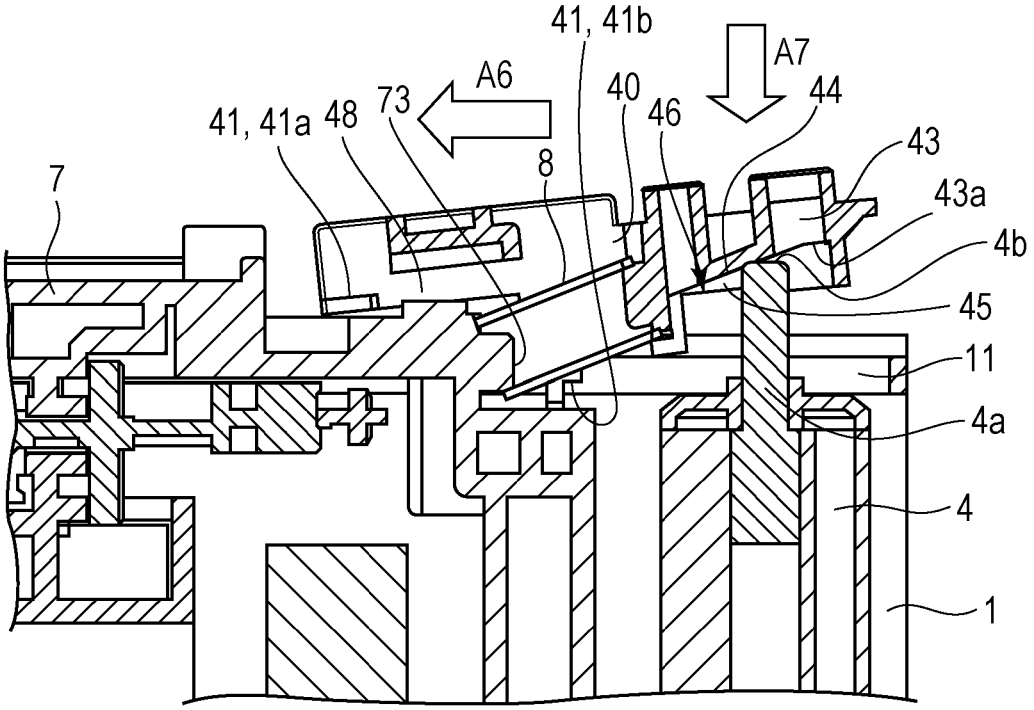
FIG. 11 is a cross-sectional view of an area in which the bearing member is to be attached to the frame, for illustrating a procedure for attaching the bearing member.

Next, with reference to FIG. 9 to FIG. 11, the procedure for attaching the bearing member 40 to the frame 7 will be described in more detail. FIG. 11 is a cross-sectional view of an area in which the back-side bearing member 40 for the tension roller 4 is attached. FIG. 11 illustrates a state in the course of attaching the back-side bearing member 40 to the frame 7 to which the intermediate transfer belt 1 and the tension roller 4 are already attached by following the above-described procedure for replacing the intermediate transfer belt 1.

First, the one end of the tension spring 8 held by the bearing member 40 is latched onto the spring latching part 73 of the frame 7. At the same time, the rotation shaft 4*a* of the tension roller 4 is guided into the guide groove 46 of the bearing member 40.

Then, while the tension spring 8 is being compressed by causing the nail parts 41 of the bearing member 40 to abut on the respective rail parts 71 of the frame 7 and to slide along the rail parts 71, the bearing member 40 is moved to the left in FIG. 11 (in the direction indicated by an arrow A6 in FIG. 11). The tension spring 8 is compressed between the step part 74 of the frame 7 and a striking part 49 of the bearing member 40. At the same time, the rotation shaft 4*a* of the tension roller 4 is guided to the hole part 43 in such a way that the end part 4*b* of the rotation shaft 4*a* in contact with the guide surface 44 slides along the guide surface 44 of the bearing member 40 while the side part 4*d* is guided along the guide walls 45.

Thereafter, the bearing member 40 is moved to such a position that the nail parts 41 pass the respective ends of the rail parts 71, the ends being positioned upstream of the urging direction of the tension spring 8. At this position, the bearing member 40 can be moved inward in the thrust direction of the frame 7, and the nail parts 41 can be placed under the respective rail parts 71 (on the thrust-direction inner side of the frame 7). In this way, the nail parts 41 and the rail parts 71 can be engaged with or disengaged from each other by moving the bearing member 40 to the predetermined portion against the urging force of the tension spring 8. When the bearing member 40 reaches this position, the bearing member 40 is pressed downward in FIG. 11 (in the direction indicated by an arrow A7 in FIG. 11). Consequently, the rotation shaft 4*a* guided along the guide surface 44 and the guide walls 45 is inserted into the hole part 43.

In this embodiment, since the rounded part 4*c* is provided to the rotation shaft 4*a* of the tension roller 4, the rotation shaft 4*a* can move along the guide surface 44 smoothly. This can reduce the operating force required to attach the bearing member 40 to the frame 7.

Thereafter, the bearing member 40 is moved by the urging force of the tension spring 8, and consequently the nail parts 41 of the bearing member 40 engage with the respective rail parts 71 of the frame 7 to hold the bearing member 40 so as to prevent the bearing member 40 from falling from the frame 7. At the same time, the tension roller 4 is urged from the inner-peripheral-surface side toward the outer-peripheral-surface side of the intermediate transfer belt 1, so that a desired tension is applied to the intermediate transfer belt 1.

Note that the bearing member 40 can be detached from the frame 7 by following the above-described procedure in reverse order.

As described above, in this embodiment, to attach the bearing member 40 to the frame 7, the bearing member 40 is moved to the predetermined portion against the urging force of the tension spring 8 while the rotation shaft 4*a* is guided to the hole part 43 along the guide surface 44. At the predetermined portion, the nail parts 41 and the rail parts 71 can be engaged with or disengaged from each other. The bearing member 40 is moved in the direction (thrust direction) intersecting with the urging direction of the tension spring 8 so as to insert the rotation shaft 4*a* into the hole part 43, the bearing member 40 is moved by the urging force of the tension spring 8, and consequently the nail parts 41 become engaged with the respective rail parts 71. In contrast, to detach the bearing member 40 from the frame 7, the bearing member 40 is moved to the above-described predetermined portion against the urging force of the tension spring 8, and the nail parts 41 become disengaged from the rail parts 71. Then, the bearing member 40 is moved in the direction (thrust direction) intersecting with the urging direction of the tension spring 8, and consequently the rotation shaft 4*a* is taken out from the hole part 43.

As described above, according to this embodiment, it is possible to apply tension to or release tension from the intermediate transfer belt 1 only by operating the bearing member 40 for the tension roller 4. Moreover, according to this embodiment, it is possible to replace the intermediate transfer belt 1 only by detaching the bearing member 40 and detaching the single roller without having to unscrew any screws. Furthermore, providing the guide surface 44, which guides the rotation shaft 4*a* of the tension roller 4 to the hole part 43 of the bearing member 40, makes it possible to attach the bearing member 40 to the frame 7 smoothly. Hence, it is possible, with the simple configuration, to easily replace the intermediate transfer belt 1, and to improve the maintainability of the intermediate transfer belt unit 105 and the image forming apparatus 100. This can prevent, for example, damage to the intermediate transfer belt 1 from occurring during replacement of the intermediate transfer belt 1.

As previously mentioned, there is a method of replacing the intermediate transfer belt 1 by folding a support unit supporting rollers around which the belt is stretched or by dividing a pair of frames forming the support unit. In such a method, the rollers around which the belt is stretched are supported by different members at the shafts provided at the respective ends of the rollers, which is likely to decrease the accuracy of alignment of the rollers. Such misalignment may cause, for example, a problem of a change (displacement) in the width-direction position of the belt, which may cause the belt to tear. To avoid such a situation, a mechanism for adjusting the alignment or a mechanism for regulating displacement of the belt is needed, which increases the complexity of the configuration. This may result in an increase in cost and a decrease in maintainability. In addition, providing the support unit with a hinge mechanism or a dividing mechanism may result in a decrease in strength of the frame forming the support unit, which may not only cause misalignment but also shorten the life of the support unit itself.

In contrast, according to this embodiment, since the frame 7 is formed integrally, it is possible to prevent changes, as a result of replacement of the intermediate transfer belt 1, in alignment of the rollers around which the intermediate transfer belt 1 is stretched. This can eliminate the need for a mechanism for adjusting alignment or a mechanism for regulating displacement of the belt, or can simplify the configuration of such a mechanism. In addition, according to this embodiment, since the frame 7 is formed integrally, a decrease in the strength of the frame 7 can be suppressed.

Others

The present invention has been described above on the basis of the concrete embodiment. However, the present invention is not limited to the above-described embodiment.

In the above-described embodiment, the belt is assumed to be an intermediate transfer belt. However, the belt is not limited to this. For example, in an image forming apparatus based on a direct transfer method in which images formed by multiple image forming units are directly transferred onto a transfer material supported and conveyed by a transfer-material support member, a transfer-material conveying belt formed of an endless belt is sometimes used as the transfer-material support member. The present invention is applicable also to such a transfer-material conveying belt in an image forming apparatus of a direct transfer type, to obtain the same effects. Meanwhile, the belt may be a photosensitive belt.

According to the above-described embodiment, the need for a mechanism for adjusting the alignment or a mechanism for regulating displacement of the belt can be reduced. However, the present invention is applicable even when one of or both of the mechanisms are provided. In such a case, as in the above-described embodiment, the effects of being capable of easily replacing the belt with a simple configuration can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-046996 filed Mar. 10, 2014, which is hereby incorporated by reference herein in its entirety.

What is claimed is:

1. A belt unit comprising:

an endless belt; and a support unit, including a tension roller, a bearing, a support part, and an urging member, configured to support the belt, the tension roller, including a rotation shaft, configured to stretch the belt, the bearing, attachable to and detachable from the support unit, configured to rotatably supports the rotation shaft, the bearing including a hole part and a guide part, the hole part, including an opening of the hole part, configured to be rotatably fitted to the rotation shaft, the guide part, including a guide face, configured to guide the rotation shaft to the opening along the guide face when the bearing is moved toward the tension roller to be attached to the support unit, the guide face, being formed at the bottom part of a guide groove, extending to the opening, the support part configured to support the bearing in a state where the bearing is movable in a direction intersecting with the rotation shaft, the urging member, disposed between the support part and the bearing, configured to apply tension to the belt by applying force in the direction intersecting with the rotation shaft to the tension roller via the bearing.

2. The belt unit according to claim 1, wherein the guide face includes walls at two respective sides, the walls guiding a side surface of the rotation shaft when the end of the rotation shaft is guided to the opening along the guide face, to prevent the end of the rotation shaft from being displaced from the guide face.

3. The belt unit according to claim 1, wherein the guide face has a concave cross-sectional shape to prevent the end of the rotation shaft from being displaced from the guide face when the end of the rotation shaft is guided to the opening along the guide face.

4. The belt unit according to claim 1, wherein a direction in which the guide face extends toward the opening when the end of the shaft is guided to opening along the guide face is inclined in relation to a direction orthogonal to the rotation shaft.

5. The belt unit according to claim 1, wherein part of the end of the rotation shaft, the part abutting on the guide face, has a curved surface shape.

6. The belt unit according to claim 1, wherein the bearing is attachable to and detachable from the support part when the bearing is moved to a predetermined portion of the support part against an urging force of the urging member.

7. The belt unit according to claim 1, wherein the bearing and the support part are movable with respect to each other along a rail part provided to at least one of the bearing and the support part.

8. The belt unit according to claim 1, wherein the urging member is held by the bearing.

9. The belt unit according to claim 1, wherein the support part includes a protrusion portion that engages with the urging member.

10. The belt unit according to claim 8, wherein the bearing includes an exposing part that exposes part of the urging member so that the urging member is detachable from the bearing member when being held by the bearing.

11. The belt unit according to claim 1, wherein the bearing, the urging member, and the support part are provided at each of two sides of the belt unit, the two sides being located in a width direction of the belt, which intersects with a moving direction of the belt.

12. The belt unit according to claim 11, wherein at least one of the bearings is attachable to and detachable from the support unit.

13. An image forming apparatus comprising:

an image forming unit;

an endless belt configured to bear an image formed by the image forming unit; and a support unit, including a tension roller, a bearing, a support part, and an urging member, configured to support the belt, the tension roller, including a rotation shaft, configured to stretch the belt, the bearing, attachable to and detachable from the support unit, configured to rotatably support the rotation shaft, the bearing including a hole part and a guide part, the hole part, including an opening of the hole part, configured to be rotatably fitted to the rotation shaft, the guide part, including a guide face, configured to guide the rotation shaft to the opening along the guide face when the bearing is moved toward the tension roller to be attached to the support unit, the guide face, being formed at the bottom part of a guide groove, extending to the opening, the support part configured to support the bearing in a state where the bearing is movable in a direction intersecting with the rotation shaft, the urging member, disposed between the support part and the bearing, configured to apply tension to the belt by applying force in the direction intersecting with the rotation shaft to the tension roller via the bearing.

* * * * *